United States Patent [19]

Solomon

[11] 4,178,091

[45] Dec. 11, 1979

[54] HORIZONTAL FILM PROCESSING APPARATUS

[75] Inventor: Victor C. Solomon, Rochester, N.Y.

[73] Assignee: Eastman Kodak Company, Rochester, N.Y.

[21] Appl. No.: 883,756

[22] Filed: Mar. 6, 1978

Related U.S. Application Data

[63] Continuation-in-part of Ser. No. 774,718, Mar. 7, 1977, abandoned.

[51] Int. Cl.[2] ..... G03D 3/02; G03D 3/08

[52] U.S. Cl. ..... 354/322; 354/323; 354/324; 354/330; 134/79; 134/92; 134/149; 134/159

[58] Field of Search ..... 354/311, 312, 313, 314, 354/315, 316, 319, 320, 321, 322, 323, 324, 328, 329, 330, 331, 337, 340, 344; 134/66, 77, 78, 79, 83, 84, 85, 86, 92, 135, 149, 159, 160

[56] References Cited

U.S. PATENT DOCUMENTS

| | | | |
|---|---|---|---|
| 1,185,191 | 5/1916 | Garland | 354/316 |
| 2,142,881 | 1/1939 | Bell | 354/330 |
| 2,349,823 | 5/1944 | Howard | 134/85 |
| 2,535,110 | 12/1950 | Wishart | 134/79 |
| 3,077,622 | 2/1963 | Murphy | 134/77 |
| 3,314,352 | 4/1967 | Grant | 354/322 |
| 3,641,906 | 2/1972 | Orr et al. | 134/78 |
| 3,760,822 | 9/1973 | Evans | 134/149 |
| 4,011,573 | 3/1977 | Braico | 354/329 |

*Primary Examiner*—L. T. Hix
*Assistant Examiner*—Alan Mathews
*Attorney, Agent, or Firm*—J. Addison Mathews

[57] ABSTRACT

Photographic processing of a plurality of film discs is accomplished by rotating the discs partially immersed in chemical solutions. Processing trays, which contain the solutions, conform to the peripheries of the discs, reducing the volumes of the solutions and making single use batches of the solutions attractive. Single and multiple-tray approaches are included and, at least in the latter case, a transport mechanism is provided for transferring the discs from tray-to-tray while rotating the discs between the trays.

24 Claims, 9 Drawing Figures

HORIZONTAL FILM PROCESSING APPARATUS

BACKGROUND OF THE INVENTION

This application is a continuation-in-part of U.S. patent application Ser. No. 774,718, filed on Mar. 7, 1977, now abandoned.

CROSS-REFERENCE TO RELATED APPLICATIONS

Reference is hereby made to commonly assigned, copending U.S. patent application Ser. No. 774,715, entitled PHOTOGRAPHIC CAMERAS, now abandoned: Ser. No. 774,716, entitled PHOTOGRAPHIC FILM UNIT AND CARTRIDGE ASSEMBLY, Ser. No. 774,719, now U.S. Pat. No. 4,132,469, entitled APPARATUS FOR SELECTIVELY VIEWING A PLURALITY OF RECORDING ELEMENTS, and Ser. No. 774,722, entitled METHOD AND APPARATUS FOR TREATING ELEMENTS OF PHOTOGRAPHIC FILM, now U.S. Pat. No. 4,112,454, all filed in the name of Donald Malcolm Harvey; Ser. No. 774,717, entitled IMPROVED ROTARY FILM PROCESSING APPARATUS, now U.S. Pat. No. 4,112,453, and Ser. No. 774,720, entitled IMPROVED VERTICAL PROCESSING APPARATUS, both filed in the name of William J. Hutchinson; and Ser. No. 774,721, entitled APPARATUS FOR PROCESSING PHOTOGRAPHIC FILM, now U.S. Pat. No. 4,112,452, filed in the name of David L. Patton, all filed on Mar. 7, 1977.

FIELD OF THE INVENTION

The present invention relates to the processing of photographic film and in particular to such processing in which batches of discrete, disc-shaped film elements are processed partially immersed in shallow processing trays. The elements can be moved sequentially through a plurality of treating stations at which different chemical processing is effected.

DESCRIPTION OF THE PRIOR ART

A multitude of devices have been heretofore devised for processing photographic film. Common concerns for processing film in any such devices are the desire to minimize mechanical contact with front and back surfaces of the film and the desire to obtain an intimate contact between the film surfaces to be processed and the processing solutions, in proper concentration and without external contaminates or carry-over between different processing solutions. A further desire from the economic viewpoint is to provide apparatus which is low in cost and simple in operation, yet capable of high quantity through-put with uniformly high quality results. The desire to minimize processing chemical usage is also a significant consideration.

Processing apparatus design is to a large extent constrained by the configuration or format of the film elements to be handled and to date most such apparatus have been adapted particularly for strip film. Two common general types of processors for strip film are (1) continuous processors in which the strip is fed by drive and guide rollers through the various processing stations and (2) reel processors in which film strips are wound spirally about a reel that are then manipulated into and out of the processing stations. Shorter strips are often spliced to form a longer strip.

Devices for processing film elements of other formats, e.g., chips, or small sheets, have not been so common. One popular approach is to support a plurality of film chips to be processed in a rack and sequentially dip the rack into treating reservoirs.

SUMMARY OF THE INVENTION

It is a purpose of the present invention to provide for processing of discrete film elements of a novel format in a manner which achieves the desirable characteristics mentioned above and offers significant advantages in various aspects over prior art devices.

Thus one object of the present invention is to improve the processing of photographic film.

Another object of the present invention is to provide improved processing of small, discrete film elements.

A more specific object is to provide such processing which minimizes mechanical contact with important image areas of the film.

Another more specific object is to enhance processing fluid contact with important image areas of the film.

Another more specific object is to provide apparatus and methods which minimizes processing liquid usage and the effects of contamination and concentration depletion.

The above and other objects and advantages are achieved in accordance with the present invention by apparatus and methods especially configured to process a plurality of disc-like film elements supported in spaced relation on a shaft passing generally through the center and normal to the face of each film disc. The image portions of the film element are located in an annular zone spaced slightly from the supporting aperture at the center of the element. When a plurality of the disc elements are arranged on the shaft, a cylindrical film unit comprising a batch of elements to be developed together is provided. In accordance with one aspect of the present invention, the elements are processed without total immersion in a reservoir configured to correspond to a portion of the film unit outline; thus minimizing the charge of processing liquid. In accordance with another aspect of the invention, film units are fed by transport means to a series of processing stations, supported with a bottom portion of the film cylinder in such processing reservoirs. A supported film unit is rotated about on its shaft by film drive means to effect thorough solution film contact without mechanical contact with image portions. After completion of the first processing treatment, the transport means moves the film unit to another station while continued rotation about its shaft by the film drive means controls the liquid from moving to the center of the film unit or discharges residual liquid. At a next processing station, the film unit is coupled to another drive means and similarly indexed into another processing solution reservoir.

BRIEF DESCRIPTION OF THE DRAWINGS

The invention is hereinafter described in connection with the attached drawings which form a part hereof and in which.

DETAILED DESCRIPTION OF THE PREFERRED EMBODIMENT

Figure 1:
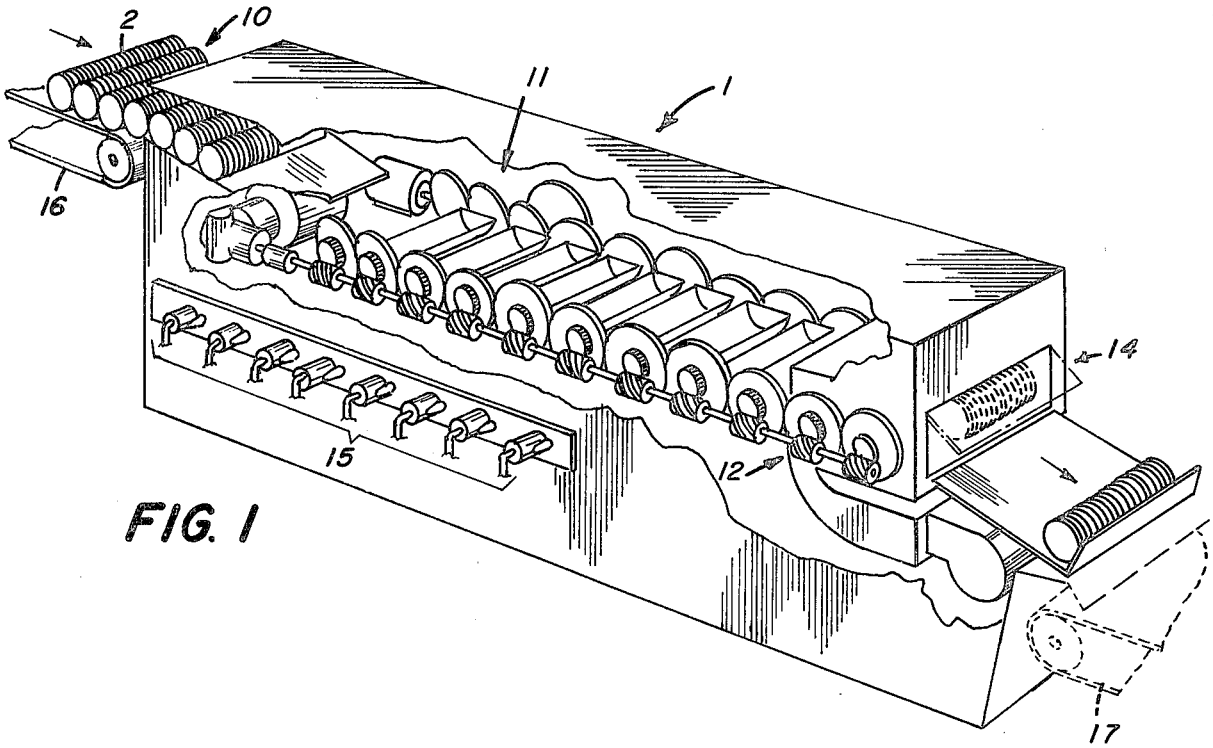
FIG. 1 is a perspective view, with portions broken away, of one embodiment of automatic processing apparatus utilizing the present invention.

The automated processing apparatus 1 shown in FIG. 1 comprises an inlet station 10 adapted to receive film units 2 of the type described with their longitudinal axis extending across the main feed path through the apparatus. Located in sequence along the film unit feed path from the inlet station 10 are a processing zone 11 including a plurality of liquid processing stations, a drying station 12 and an outlet 14. Located on one side of the apparatus are a plurality of conduits 15 which introduce and discharge processing liquid into respective processing stations in a timed sequence to be described subsequently in more detail. As shown, the apparatus 1 is adapted to be incorporated in a greater automated apparatus, illustrated schematically as including inlet and outlet conveyors 16 and 17.

Figure 2:
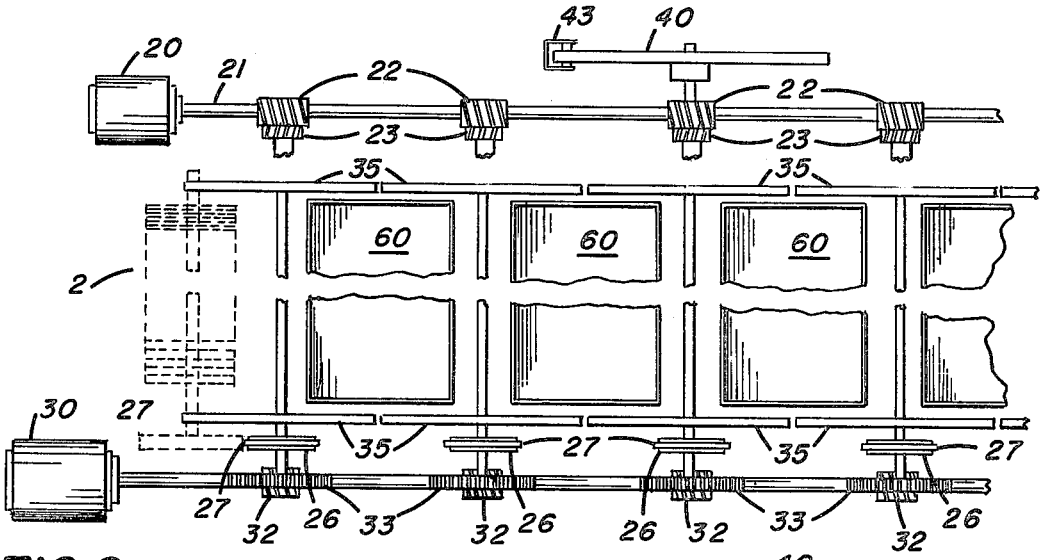
FIG. 2 is a top view illustrating the film unit drive system within the apparatus shown in FIG. 1.
Figure 3:
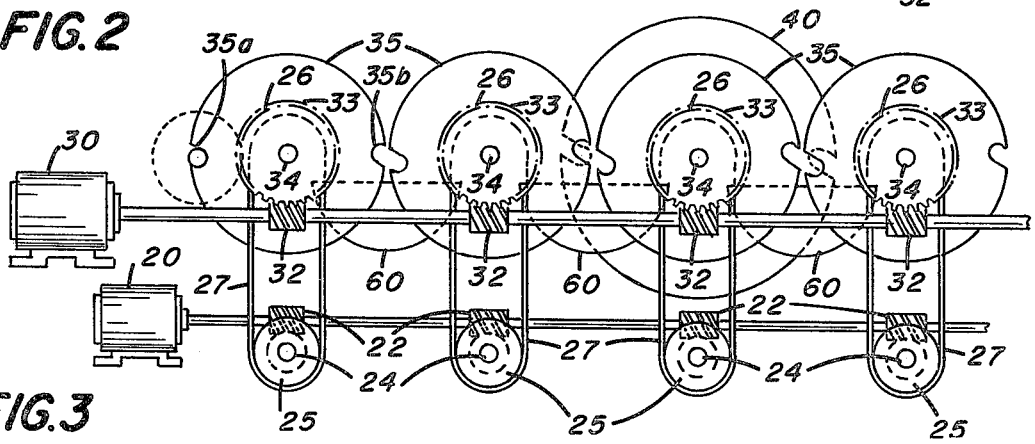
FIG. 3 is a side view illustrating the film unit transfer system within the apparatus shown in FIG. 1.
Figure 4:
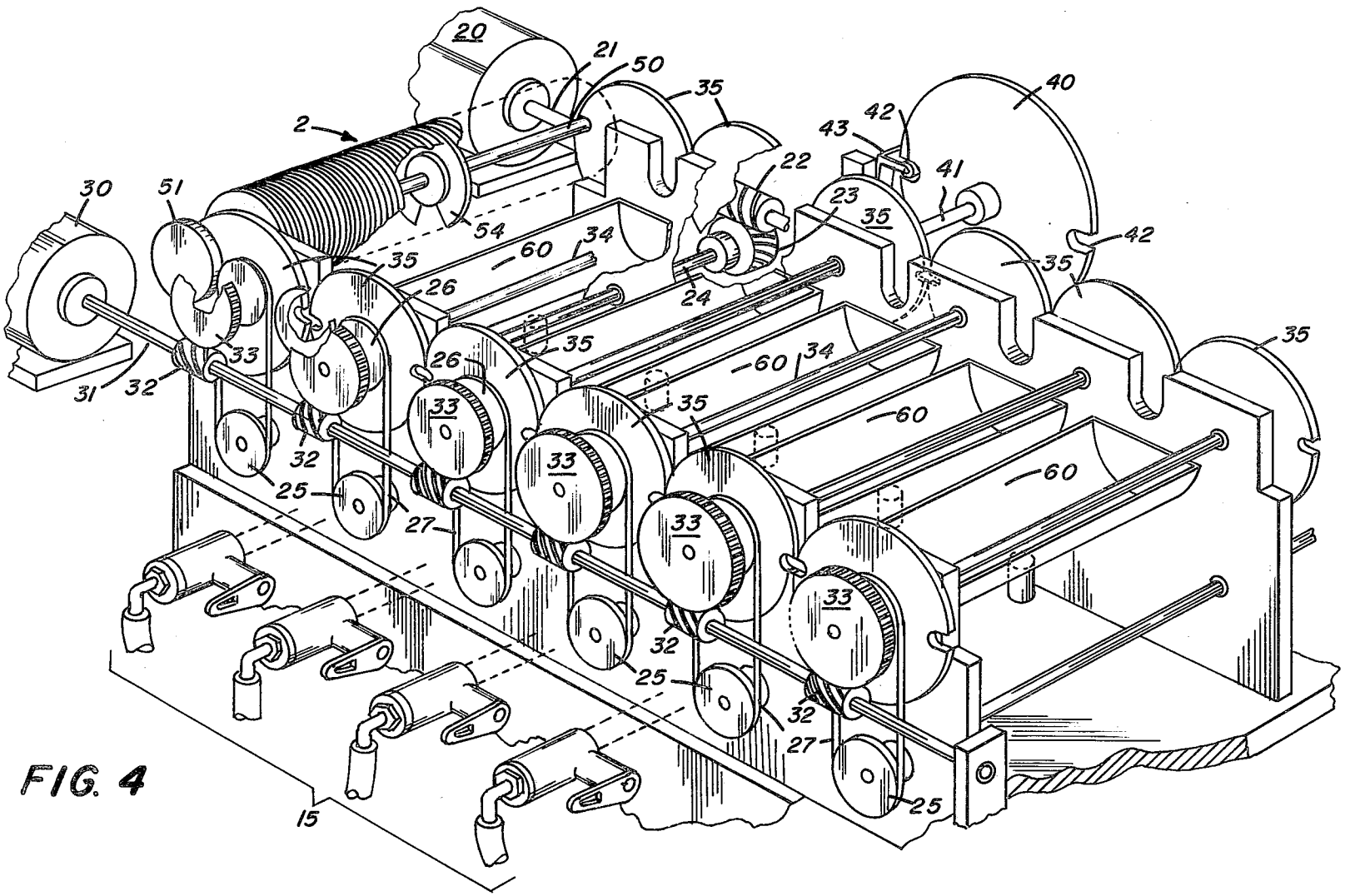
FIG. 4 is an enlarged perspective view of an internal portion of the apparatus shown in FIG. 1.

Referring now to FIGS. 2, 3, and 4, the drive system for rotating the film units on their longitudinal axis during passage through the apparatus will be described. As shown, a film drive motor 20 has an output shaft 21 on which are affixed a plurality of worm gears 22. Gears 23 respectively drivingly mate with gears 22 for transmitting drive from the motor 20 beneath the film unit feed path, via shafts 24, to drive pulleys 25. Drivingly coupling pulleys 25 respectively with pulleys 26 are "O-ring" drive belts 27. Pulleys 26 are mounted for free rotation on (not keyed to) shafts 34 and of diameter such that the O-ring belt passing therearound can drivingly engage an end portion of a film unit, which is supported adjacent thereto by the film unit transport system in a manner next to be described with continued reference to FIGS. 2–4.

The film unit transport system comprises a transport drive motor 30 having a drive shaft 31 on which are affixed worm gears 32. Gears 33 respectively mate with each of the worm gears and are keyed on shafts 34 to transmit rotation to indexing discs 35, which likewise are keyed to shafts 34, one on each side of the film unit transport path as best shown in FIGS. 2 and 4. As also shown in FIGS. 3 and 4, each of the film unit transport discs have a pair of notches 35*a* and 35*b* extending diagonally inwardly from the disc periphery. The notches 35*a* are diametrically opposite notches 35*b* on the discs and all transport discs are of the same diameter and oriented on their shafts so that one notch on each disc will move to the aligned, film-unit-passing orientation shown in FIG. 3 during a one-half cycle of rotation of the disc 35. As shown in FIG. 3, the off radial slant of the slot in the disc is directed so as to assist retention of the shaft of a film unit in the upward transport of the film unit (clockwise rotation of the disc as viewed in FIG. 3) and assist in gravity discharge of the film unit shaft into the notch of the next contiguous disc during downward transport of the film unit.

Figure 6:
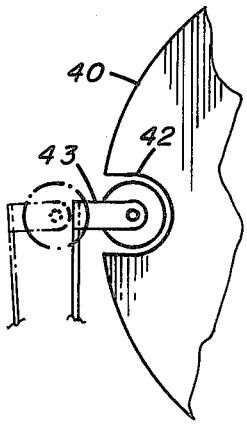
FIG. 6 is an enlarged view of a portion of the apparatus shown in FIG. 4 illustrating details of the control of the apparatus.

As shown in FIGS. 2–4, a timing disc 40 is keyed to an extension 41 of one of the transport disc shafts 34 and rotates synchronously with the timing discs. The timing disc includes two switch actuating notches 42, diametrically opposed on the disc periphery. A control switch 43, shown in more detail in FIG. 6, is mounted for movement toward and away from the timing disc 40, and biased toward the disc. After movement to the dotted-line position shown in FIG. 6 by rotation of the disc 40, the switch 43 is retained in that position and follows the outer disc periphery until falling into the opposite slot, after a 180° rotation of the shaft 41 (and of all transport discs 35). The movement back into a slot 42 actuates de-energization of motor 30 and of a transport cycle as will be explained in more detail after a description of the film units 2 utilized in apparatus 1. It will be appreciated that synchronization could be accomplished by optical sensors or other position detecting systems known in the art.

As best shown in FIGS. 2 and 4, the film unit 2 can comprise an elongated shaft 50, having on one end thereof a drive disc 51 having a serrated or otherwise roughened peripheral edge. The shaft 50 is of sufficient length and the drive disc 51 of sufficient diameter that the disc 51 can drivingly engage O-rings 27, when supported by transport discs 35 as shown in FIG. 4. On the shaft 50, a plurality of film discs 54 are mounted by a central aperture. A central portion of the film disc provides frictional or keyed engagement between the shaft and film disc and also spaces adjacent film discs sufficiently to avoid inter-film contact and allow processing solution access.

In operation, a film unit is released through the inlet 10 and can roll into a nested position in slots 25*a* of the first pair of transport discs as shown in FIG. 3. A cycle of operation is then actuated by the operator and motor 30 is energized to move transport discs 35 and timing disc 40 through a 180° rotation. This rotation locates the film unit in a supported position in the next transport disc 35 which, as will be apparent from FIGS. 1 and 4, will locate the lower portion of the film discs in the first processing tray. Motor 20 can be energized simultaneously with motor 30 and drive is thus transmitted to the film unit via "O-ring" belt 27 and drive disc 51 of the film unit; however, motor 20 is not de-energized after the 180° rotation and continues to rotate the film unit in the first processing tray 60. After a predetermined period of treatment in the first processing tray, the motor 30 is again energized to transport the film unit to the next processing tray in the same manner described above. Concurrently, a new film unit can be fed into the processing position in the first processing tray. The motor 20 can desirably remain energized during the film unit transport and continues to rotate the film unit during transport between processing trays. Control means, of a type readily understood by one skilled in the art and not described herein in detail, continue to sequentially initiate successive film transport cycles of motor 30 between predeterminedly times processing cycles until the film unit has passed through drying section 12 and exits the apparatus with film fully processed.

In timed relation with the film unit transport between processing trays, predetermined quantities of processing solutions, such as developer, fix and wash solutions, are introduced into the processing trays by conduits 15. More specifically, a predetermined quantity of developer is introduced into processing tray 60 prior to each processing cycle and discharged after completion of the cycle. The discharge and replenishment desirably is effected during film unit transport to the next tray, which may contain, e.g., a newly introduced fix solution. It will be noted that the rotation of the film unit during processing allows substantially less than total immersion of the film and thus the liquids for a single processing cycle can be introduced and discharged for each film unit treatment. The electrically-controlled plumbing system for performing these functions is of a type readily understood and is not described herein in detail. However, larger liquid reservoirs could be provided for processing the film units or recirculating liquid to the shallow trays 60.

It will be apparent to one skilled in the art that the apparatus disclosed is admirably suited for continuous throughput of film requiring differing processing periods in the different solutions. That is, a plural number of developer, fix and/or wash trays can be provided so as to additively provide a selected processing time in a particular solution, e.g., the first two trays could be developer, the next two fix and last four wash if the chemistry of the developing process and film so required. Thus, with the cycle between inter-tray transports remaining constant to allow continuous throughput, the treatment time with a particular solution can differ by arrangement of solutions in the trays.

Figure 5:
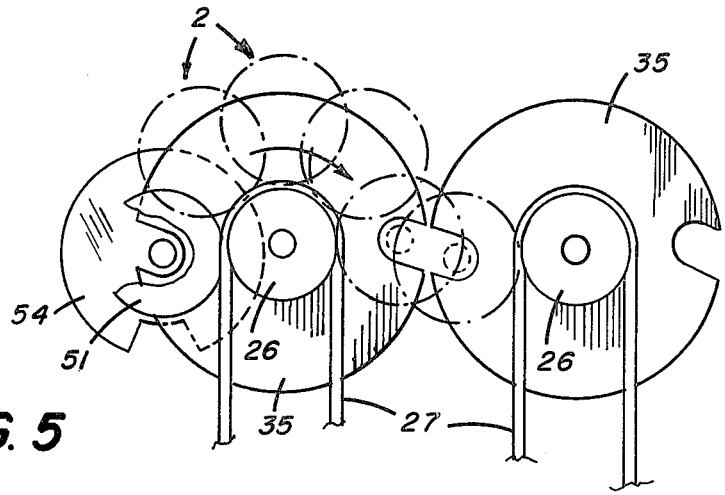
FIG. 5 is a schematic illustration of the operation of a portion of the film unit transfer system of the embodiment shown in FIG. 1.

Referring now to FIG. 5, it will be seen that another important feature of the present invention provides for the continuous rotation of the film units during transport between processing trays. As shown, the drive disc 51 is maintained by gravity in driving engagement with a first belt 26 substantially until it moves into nesting position on the next successive transport discs 35. This spinning action is particularly advantageous in maintaining processing solution on the film surface so as not to accumulate in large masses during transport. Also, this spinning action can be utilized to effect removal of residual processing liquid from the previous tray prior to introduction of the film into a different solution tray, in which case appropriate baffle structure, of a type known in the art but not shown, may be desired.

As will be noted in FIG. 4, which for ease of illustration shows only five processing stations, a separate drive can be provided to particular stations. Thus, if it is desirable to provide a higher velocity rotation for drying, a separate faster drive can be supplied.

Although the embodiment of the invention just described employs a plurality of reservoirs 60 with different fluids, it will be appreciated that certain advantages of the present invention pertain to the use of a single tray embodiment. For example, the film unit could be supported and rotated in a single tray with different processing fluids sequentially introduced into, and discharged from, the tray. Such an approach is depicted in FIGS. 7–9.

In the single-tray embodiment, the processing apparatus 100 includes a processing zone 111 and a drying zone 112 which are coupled together, such as by hinge 113, to define a single processing and drying chamber. On the sides and bottom of the chamber, a plurality of conduits 115 are suitably located for introducing and discharging batches of the processing chemicals in a timed sequence. A motor 120, coupled to the film discs through a magnetic collar 124, at one end of the chamber, rotates the film discs in a sequence related to the solution sequence and including some time periods when the solutions are in the chamber, other time periods between the discharge of one batch of solutions and the introduction of a subsequent batch of solutions, and still other time periods after all of the solutions in a particular processing sequence have been discharged from the chamber. The top of the chamber includes a heating element 153, fan 154, and appropriate baffling structure 155 and 156 for drying the film discs at the completion of the processing sequence.

In operation, a film unit 2, including the film discs 54, mounted on shaft 50, are manually positioned in notches 168 in processing tray 160. A driving puck 151 at one end of the shaft is received within the magnetic collar 124 so that rotation of the motor 120 will magnetically induce rotation of the shaft 50 in notches 168, and film discs 54 in tray 160. It should be noted that the film discs are packed closely together in parallel relationship normal to the shaft, but the imaging surfaces of the film discs are axially spaced on the shaft sufficiently so they don't touch and to allow passage of the processing chemicals therebetween. Additionally, the tray 160 has the shape of a semi-cylinder or the sector of a cylinder which conforms to the circular periphery of the film discs 54 and film unit 2.

Figure 7:
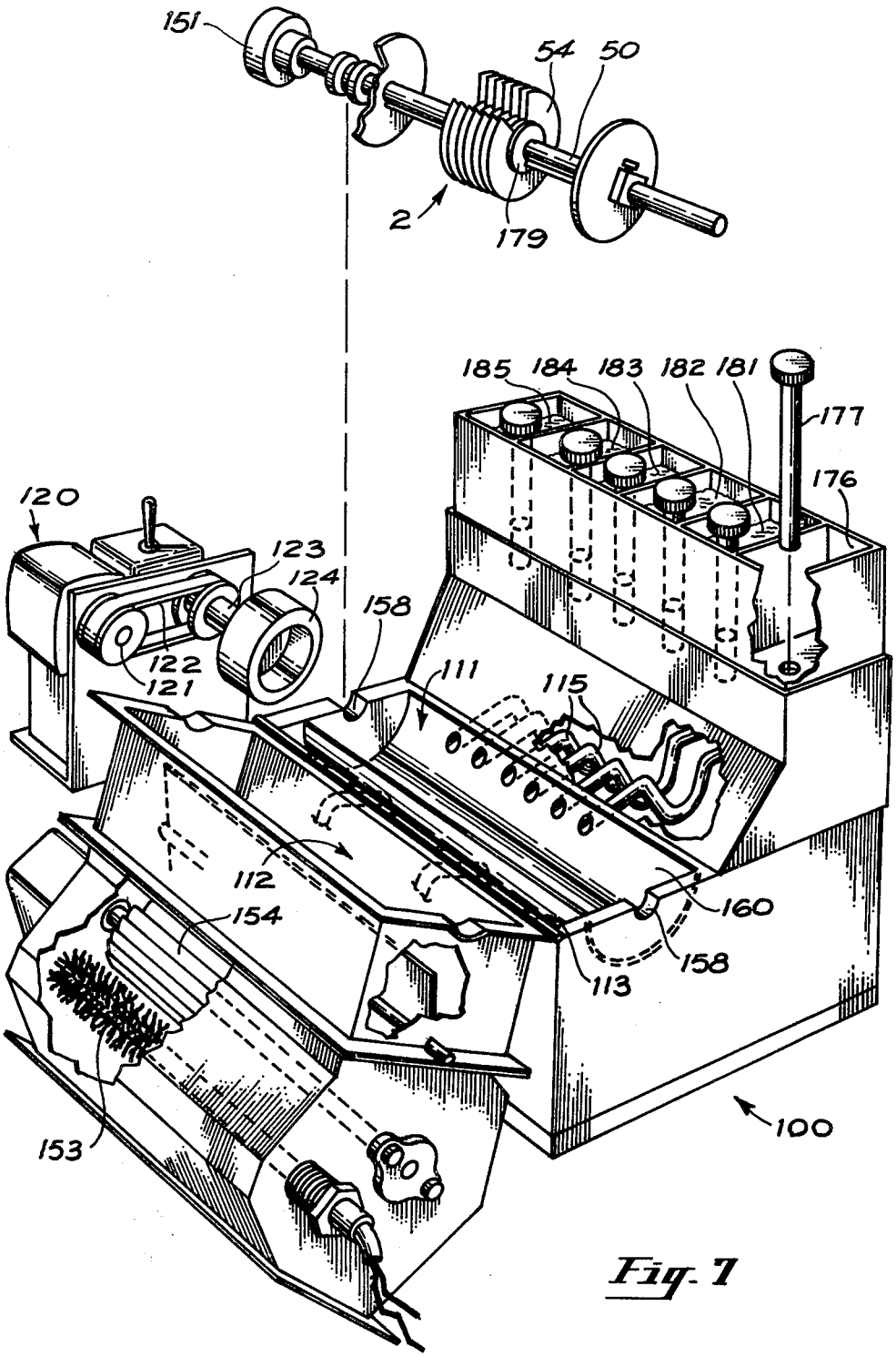
FIG. 7 is a perspective view of an alternative embodiment of the processing apparatus in accordance with the present invention, with the top pivoted away from its processing position to permit loading of the apparatus.
Figure 8:
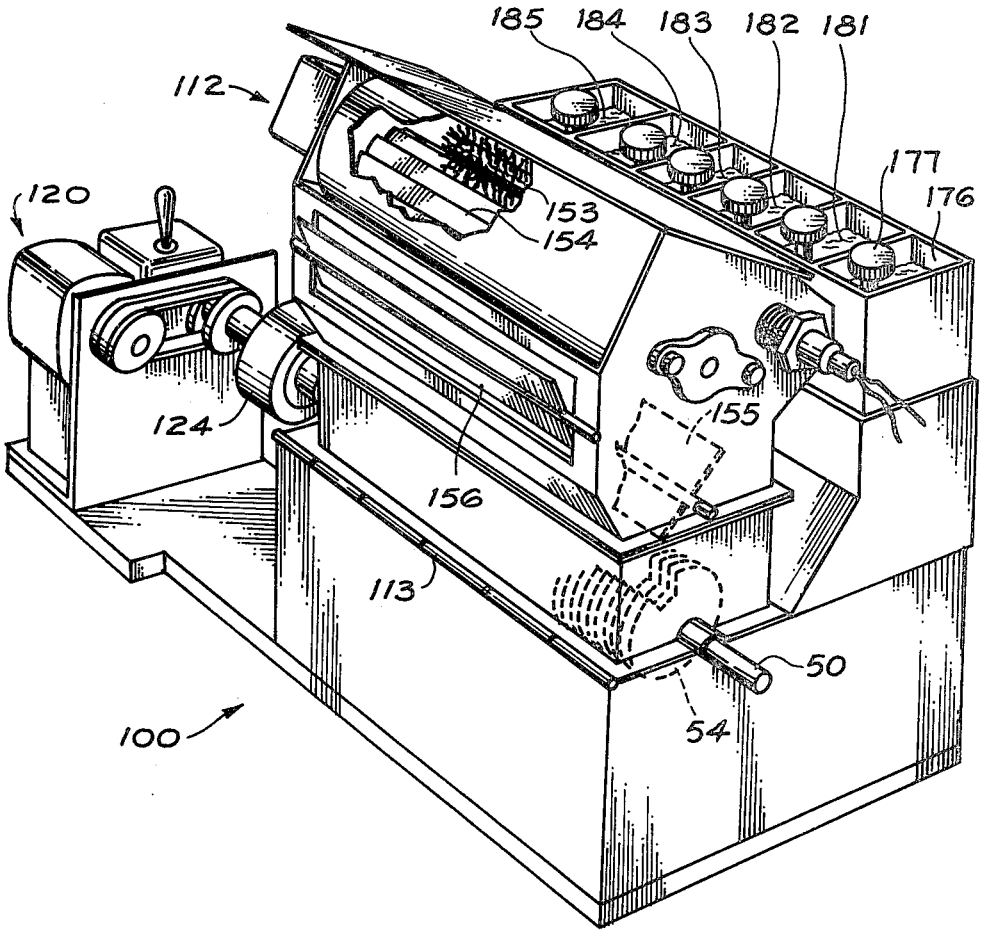
FIG. 8 is a perspective view of the apparatus of FIG. 7 with the top in a closed or processing position.
Figure 9:
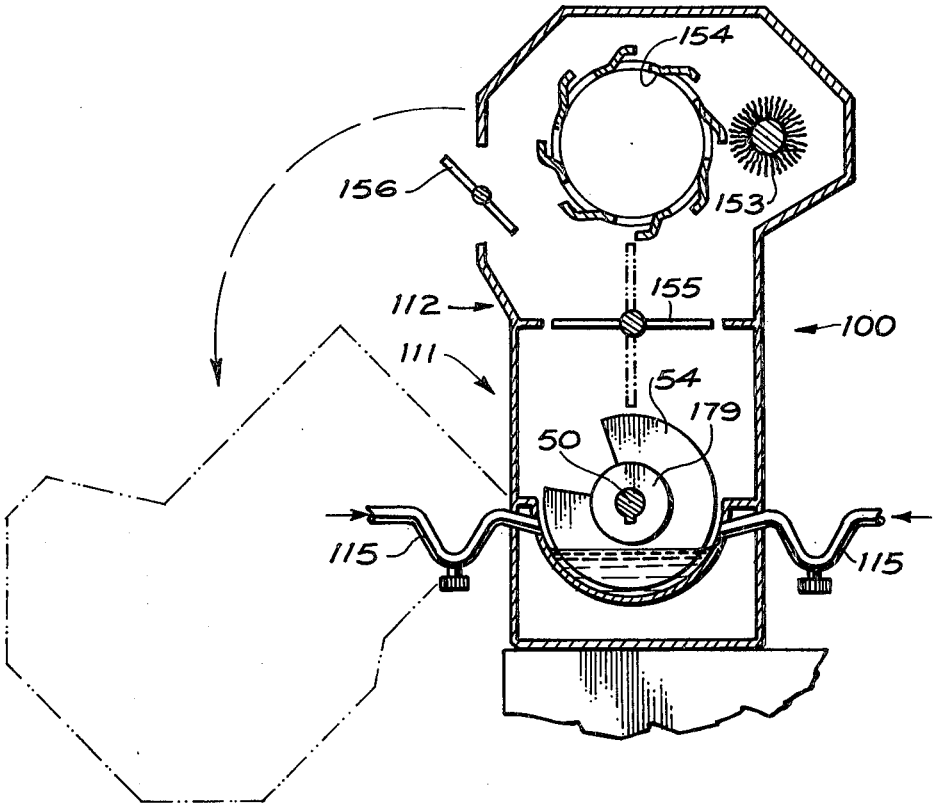
FIG. 9 is a cross-sectional end view of the apparatus of FIG. 7 depicting the processing chamber and the level of processing solution therein.

After the film discs are properly positioned in the tray, the chamber is closed by rotating the drying section 112 from the position depicted in FIG. 7 to the position overlying the processing section 112 as depicted in FIG. 8.

Baffle 155 is in the closed position (solid lines in FIG. 9) to reduce heat loss from the processing zone and to eliminate the need for solution heating elements around tray 160.

With the film discs fully enclosed, motor 120 is energized and a first solution, such as developer is introduced from reservoir tank 176 via one of the conduits 115. Merely removing the plug 177 is sufficient for a premeasured quantity of the developer to flow under the influence of gravity to a predetermined level in the tray. The conduit enters the tray at an angle (FIG. 9) to wash the sides of the tray and to direct the developer away from a core section 179 of the film discs without significantly wetting the core section. Similarly, the quantity of the developer is selected to fill the chamber to a level which immerses only a part of the film discs not including the core section. This level is sufficient to contact the entire annular imaging area of the film elements as the elements are rotated on edge in the tray, but insufficient to cover the hubs of the film elements during such rotation.

As the film discs rotate, successive portions of the imaging surfaces will be presented to the developer, thus wetting the imaging surfaces and agitating the developer. At the same time, however, the core section will remain essentially dry, except, perhaps, around its outermost edge.

After development is completed, the developer is drained from the tray and a second solution, such as a rinse 181, is added. The sequence is essentially the same as for the developer and is repeated several times for the several other solutions 182, 183, 184, and 185 until the processing solution cycle is completed. Rotation of the film discs in the chamber is continued or even increased between immersion in the successive solutions to spin-off any excess of the solutions.

Finally, the film discs are dryed, while they remain in the same tray 160, by opening the baffle 155 and energizing fan 154 and heater 153. At the same time, the rotational speed of the film elements may be increased to enhance the drying action.

Still other advantages of the present invention can result from combining features of the multiple chamber approach with features of the single chamber approach. For example, a two chamber processor might include one chamber for developer solution and another chamber for the remaining solutions. In such a case, the developer solution might be replenished as needed, while the other solutions might be supplied as sequential batches of chemicals which are not intended for reuse.

It should now be apparent that the structure and method of the present invention provides significant advantages not available from or taught by the prior art.

Chemical processing solutions can be utilized in such an efficient manner that it may be practical in many instances to use batch (not replenished) chemicals not intended for reuse. This will eliminate the need for recirculation pumps, heaters and concentration-sensing controls. In a similar respect, the small quantities of chemicals make it practical to use fewer processing chambers than there are solutions, by quickly interchanging several solutions in a single chamber. Equally important, a relatively high volume throughput is possible in very compact apparatus, whether manually or automatically operated, without sacrificing quality.

Other advantages will become apparent from the above description to those who are skilled in this art.

The invention has been described in detail with particular reference to preferred embodiments thereof, but it will be understood that variations and modifications can be effected within the spirit and scope of the invention.

I claim:

1. Apparatus for processing in a photographic processing solution a plurality of similar, disc-shaped film elements supported on a shaft passing through central sections of the elements; each such element having a peripheral edge and including an annular imaging area extending radially inwardly for a predetermined distance from the edge to the central section; said apparatus comprising:

a housing having a chamber for processing solution, said chamber having an elongate transversely concave bottom surface and adapted to be filled with the processing solution to a depth not substantially exceeding said radial distance;

means for supporting the shaft relative to said housing with the shaft extending in the direction of elongation of said bottom surface and with the edges of the film elements in close proximity to said bottom surface, whereby only the annular area of each film element is contacted by the processing solution; and means for rotating the elements on the longitudinal axis of the shaft to move the annular area of each element through the processing solution.

2. Apparatus for processing in a photographic processing solution a plurality of substantially identically disc-shaped film elements supported in side-by-side relationship on a shaft passing through central openings in each element; each such element having peripheral edge and an annular area between the edge and the central opening for recording latent images; said apparatus comprising:

a housing having a chamber for receiving the processing solution, said chamber having a bottom surface generally complimentary in curvature to the peripheral edges of the film elements;

means for supporting the shaft on said housing to rotatably support the film elements in the chamber with the peripheral edges of the film elements in closely spaced relationship with said bottom surface;

means for rotating the supported film elements on the longitudinal axis of the shaft; and means for filling the chamber with the processing solution to a predetermined level sufficient when the film elements are rotated to cause the processing solution to contact the annular areas of the elements without contacting their central openings.

3. Apparatus for processing in photographic processing solutions a plurality of film elements having substantially the same disc shape and supported on an elongate shaft passing through an aperture in the center of each element; said apparatus comprising:

a processing tray for containing processing solution, said tray having a transversely concave bottom wall;

means for supporting the shaft over the tray with the edges of the film elements in close proximity to said bottom wall;

means for sequentially supplying a plurality of different processing solutions to said tray to fill the tray successively with the respective solutions to a level covering only that portion of the film elements between the shaft and said bottom wall; and means for rotating the supported film elements on the longitudinal axis of the supported shaft.

4. Apparatus for processing in photographic processing solutions a plurality of disc-shaped film elements supported on a shaft passing through central sections of the respective elements; each such element having the same shaped generally circular peripheral edge and an annular imaging area of predetermined radial dimension; said apparatus comprising:

a housing;

means in said housing for containing batches of processing solutions;

a chamber in the housing for receiving the respective batches of processing solution from said containing means, said chamber having an elongate concavely shaped bottom surface and a volume which when filled with the respective batches of processing solutions provides predetermined depths of the solutions not exceeding said radial dimension;

means for sequentially delivering the respective batches of processing solutions from said containing means to said chamber;

means for supporting the shaft on said housing with the edges of the film elements in close proximity to said bottom surface whereby only a radial portion of each annular imaging area is contacted by processing solution; and means for rotating the elements to cause the entire annular imaging area of each element to be contacted by processing solution.

5. A single chamber photographic processor for processing with a plurality of processing solutions, and drying, a plurality of similar film elements supported on a shaft; said processor comprising:

a container for processing solution;

means for supporting the shaft and film elements in said container;

means for sequentially filling said container with, and draining from said container, a plurality of processing solutions to sequentially bring the processing solutions into contact with the film elements;

means for circulating air to the film elements to dry the elements; and means for rotating the elements at a first speed when the film elements are contacted by processing solution to enhance the contact between the elements and processing solution and at a second speed when air is circulated to the film elements to enhance drying of the elements.

6. Apparatus for processing in a photographic processing solution a plurality of disc-shaped film elements supported on a shaft passing through central sections of the elements; each such element having a generally circular peripheral edge bounding an annular area in which latent images are adapted to be recorded, the annular area of each film element having substantially the same radial width; said apparatus comprising:

a housing having a plurality of tandemly arranged chambers to receive separate processing solutions, each said chamber having an elongate transversely curved bottom surface and adapted to be filled with processing solution to a depth covering the radial width of the annular area;

means for simultaneously supporting a plurality of the shafts in said respective chambers respectively with the shafts extending in the direction of elongation of the respective chamber bottom surfaces and with the edges of the respective film elements in close proximity to said bottom surfaces, whereby only the annular image area of the film elements are contacted by processing solution in the respective chambers;

means for rotating the elements on the longitudinal axis of each shaft to move the annular image area of each element through processing solution; and means for simultaneously transporting each of the plurality of shafts from the supporting means of one chamber to the supporting means of another chamber to cause the film elements to sequentially contact the processing solutions in said chambers.

7. Apparatus as claimed in claim 6, wherein the rotating means rotates the elements both in the chambers and during transport between the chambers.

8. Apparatus for processing in photographic processing fluids a plurality of discrete, similarly disc-shaped film elements supported on a shaft, each element having a central aperture for receiving the shaft and an annular image area radially spaced from said aperture, said apparatus comprising:

(a) a plurality of containers for the respective processing fluids, said containers being positioned in tandem relationship to define a processing path;

(b) means for transporting a shaft to move its supported film elements along said processing path and into and out of contact with the processing fluids in said containers; and (c) drive means for rotating a shaft to rotate its supported film elements about the longitudinal axis of the shaft both during contact with the processing fluids and constantly during transport along said path.

9. Apparatus as claimed in claim 8 wherein said transport means includes a pair of transport discs associated with each container, each pair of transport discs being located respectively on opposite sides of said processing path and having peripheral portions for engaging and rotatably supporting the ends of a shaft; and means for rotating each pair of transport discs to move a supported shaft in an arcuate path into and out of the respective containers, said disc pairs being located contiguously along said path whereby a shaft is transferred from the peripheral portion of one transport disc pair to the peripheral portion of the next successive transport disc pair.

10. Apparatus as claimed in claim 9 wherein said drive means includes a plurality of drive transmitting members associated with said containers respectively for transmitting drive to a shaft while supported by a transport disc pair.

11. Apparatus for processing in photographic processing fluids a plurality of discrete, disc-shaped film elements supported on a shaft; all of the elements having substantially the same diameter, a central support aperture for receiving the shaft and an annular image portion spaced from said aperture; said apparatus comprising:

(a) a plurality of reservoirs for processing solutions supported in said apparatus in aligned spaced relation along a generally horizontal path, said reservoirs having a depth less than the diameter of the film elements;

(b) transport means for receiving and supporting a shaft and for transporting the shaft into contact with the processing solutions in sequence to move the film elements along said path and into and out of the processing solutions; and (c) drive means adjacent each of said reservoirs, said drive means including means for rotating the shaft and the supported film elements when the shaft is in contact with a processing solution.

12. Apparatus as claimed in claim 11 wherein said transport means:

includes a pair of transport discs associated with each reservoir, each pair of discs located on opposite sides of said path respectively and having peripheral portions for rotatably supporting end portions of a shaft; and means for rotating each pair of transport discs to move a supported shaft in an arcuate path into and out of the respective container, said transport disc pairs being located contiguously along said path whereby a shaft is transferred from the peripheral portions of one pair to the peripheral portion of an adjacent pair;

and wherein said drive means rotates a shaft during transport between reservoirs.

13. Apparatus for processing in processing fluids a plurality of discrete, disc-shaped film elements having a central support aperture and an annular image portion radially spaced from said aperture, a plurality of such elements being mounted on an elongated shaft extending through the apertures of such elements, the shaft having a longitudinal axis normal to the disc face surfaces and having a drive disc fixed to one end portion thereof, the shaft and the film discs thereon constituting a film assembly for processing; said processing apparatus comprising:

(a) a plurality of processing reservoirs for the respective processing fluids, said reservoirs located in said apparatus in spaced relation along a generally horizontal path;

(b) transport means for receiving and supporting such a film assembly and for transporting such assembly along said processing path and in sequence into and out of said processing reservoirs to thereby move the film elements in sequence into and out of contact with the processing fluids; and (c) drive means for engaging the drive disc of a film assembly received by said transport means and for rotating said film assembly about the shaft axis during movement of the film assembly along said path and during movement of the film assembly into and out of each reservoir.

14. A method for, processing in a container for processing composition, disc-shaped film elements supported on a shaft passing through a central section of the elements; all of the elements having a peripheral edge of substantially the same shape, and an annular area for recording latent images, the annular area extending radially inward from the edge for a predetermined radial distance; said method comprising the steps of:

supporting the shaft horizontally with the film elements at least partially in the container;

filling the container with the processing composition to a predetermined level sufficient to cover the radial distance of the annular area but insufficient to cover the central section; and rotating the film elements on the longitudinal axis of the shaft to cause the entire annular area to be contacted by the processing composition.

15. The method as claimed in claim 14 further comprising the steps of: separating the film elements from the processing composition and; after such separation, rotating the film elements to remove excess processing composition from the film elements.

16. The method claimed in claim 15 wherein the processing composition is removed from the container to separate the film elements from the processing composition.

17. The method claimed in claim 15 wherein the film elements are removed from the container to separate the film elements from the processing composition.

18. The method as claimed in claim 15 further comprising the step of circulating heated air to the film elements during rotation of the elements after separation of the film elements from the processing composition.

19. A method for processing a plurality of similar disc-shaped film elements in a processing solution, the processing solution being contained by a tray having a concavely shaped bottom wall; the film elements each having a central section and a peripheral edge with an annular area therebetween for recording latent images; said method comprising the steps of:

supporting the film elements vertically in the tray with the peripheral edges of the film elements in close proximity to the concavely shaped bottom wall;

establishing a level of processing solution in the tray which is sufficient to cover annular portions of the annular image-recording areas but insufficient to cover the central sections of the film elements; and rotating the supported film elements in the tray to move the entire annular image-recording area of each element into contact with the processing solution.

20. The method as claimed in claim 19 further comprising the steps of: separating the film elements from the processing solution; and thereafter drying the film elements by circulating air thereto.

21. The method as claimed in claim 19 further comprising the step of rotating the film elements during the drying of the elements with the circulated air.

22. A method for processing a plurality of disc-shaped film elements in a plurality of processing solutions contained in trays each having a concavely shaped bottom wall; the film elements each having a central section and a peripheral edge with an annular area therebetween for recording latent images; said method comprising the steps of:

supporting the film elements vertically in one tray with the peripheral edges of the film elements in close proximity to the concavely shaped bottom wall of said one tray;

establishing a level of processing solution in said one tray which is sufficient when the film elements are rotated to contact the entire annular image-recording areas, but insufficient to contact the central sections of the film elements, with the processing solution;

rotating the supported film elements in said one tray to move the entire annular image-recording area of each element into contact with the processing solution;

supporting the film elements vertically in another tray with the peripheral edges of the film elements in close proximity to the concavely shaped bottom wall of said one tray;

establishing a level of processing solution in said another tray which is sufficient when the film elements are rotated to contact the entire annular image-recording areas, but insufficient to contact the central sections of the film elements, with the processing solution; and rotating the supported film elements in said another tray to move the entire annular image-recording area of each element into contact with the processing solution.

23. The method according to claim 22 further including the steps of removing the film elements from the trays and spinning the removed film elements to eliminate excess of the solutions from the elements.

24. A method for processing in a processing liquid, a plurality of similarly-shaped film elements, each film element having a central section, a curved peripheral edge, and an annular area of a predetermined radial dimension therebetween for recording latent images; said method comprising the steps of:

mounting the film elements in side-by-side relationship on a common axis passing through the central sections of the elements;

partially immersing said mounted elements in an elongated body of processing liquid having a maximum depth approximating the radial dimension, and having a transversely diminishing depth from its center toward each side corresponding to the curvature of the peripheral edges of the film elements; and rotating said partially immersed elements on the axis to contact the entire annular area of each film element with the processing liquid.

* * * * *